US009589748B2

(12) United States Patent
Heater et al.

(10) Patent No.: US 9,589,748 B2
(45) Date of Patent: Mar. 7, 2017

(54) CYCLE SELECTOR KNOB TO ROTARY ENCODER USER INTERFACE

(71) Applicant: Whirlpool Corporation, Benton Harbor, MI (US)

(72) Inventors: Timothy E. Heater, Hartford, MI (US); Sithaarth T. Subramaniyam, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 14/186,596

(22) Filed: Feb. 21, 2014

(65) Prior Publication Data

US 2014/0262701 A1 Sep. 18, 2014

Related U.S. Application Data

(60) Provisional application No. 61/791,440, filed on Mar. 15, 2013.

(51) Int. Cl.

| | |
|---|---|
| ***H01H 9/18*** | (2006.01) |
| ***H01H 19/00*** | (2006.01) |
| ***G05G 1/08*** | (2006.01) |
| *H01H 3/32* | (2006.01) |

(52) U.S. Cl.

CPC ..... *H01H 19/005* (2013.01); *G05G 1/08* (2013.01); *H01H 9/18* (2013.01); *H01H 2003/326* (2013.01)

(58) Field of Classification Search

CPC ..... H01H 2003/085; H01H 2003/326; H01H 9/18; H01H 1/08; H01H 19/055

USPC ..... 200/11 R, 316, 336, 4

See application file for complete search history.

(56) References Cited

U.S. PATENT DOCUMENTS

| | | | | |
|---|---|---|---|---|
| 6,281,453 | B1 * | 8/2001 | Uleski | B60Q 1/0076 200/336 |
| 7,180,023 | B2 | 2/2007 | Seo | |
| 7,205,495 | B2 | 4/2007 | Mazur | |
| 7,943,878 | B2 | 5/2011 | Hamm | |
| 2008/0236329 | A1 * | 10/2008 | Slavin | G05G 1/10 74/553 |
| 2008/0289940 | A1 * | 11/2008 | Kim et al. | 200/336 |

(Continued)

FOREIGN PATENT DOCUMENTS

| | | | |
|---|---|---|---|
| DE | 29516875 | U1 | 5/1996 |
| DE | 102009041244 | A1 | 4/2011 |

(Continued)

OTHER PUBLICATIONS

German Search Report for Counterpart DE102014102556.3, dated Nov. 26, 2014.

*Primary Examiner* — Renee Luebke
*Assistant Examiner* — Ahmed Saeed

(57) ABSTRACT

A cycle selector knob to rotary encoder user interface for the operation of an appliance has a knob for rotating a shaft of a rotary encoder wherein the shaft is received by a control panel barrel to provide radial and thrust bearing surfaces. The knob has an axial boss dimensioned to affix to the shaft and bear against the radial bearing surface of the barrel and a shoulder to bear against the thrust bearing surface of the barrel. The control panel is secured to a console so that radial and thrust forces of the knob are directed via the radial and thrust bearing surfaces only to the console through the control panel.

18 Claims, 1 Drawing Sheet

(56) References Cited

U.S. PATENT DOCUMENTS

| | | | | |
|---|---|---|---|---|
| 2009/0014306 | A1* | 1/2009 | Swamy | H01H 3/022 200/530 |
| 2012/0012721 | A1 | 1/2012 | Baier | |
| 2013/0154627 | A1 | 6/2013 | Pfenning | |
| 2014/0192013 | A1* | 7/2014 | Lubert | G06F 3/044 345/174 |

FOREIGN PATENT DOCUMENTS

| | | | |
|---|---|---|---|
| DE | 102010036006 | A1 | 3/2012 |
| DE | 102013001682 | A1 | 9/2013 |
| KR | 2020090002398 | U | 3/2009 |
| KR | 1020100052214 | A | 5/2010 |

* cited by examiner

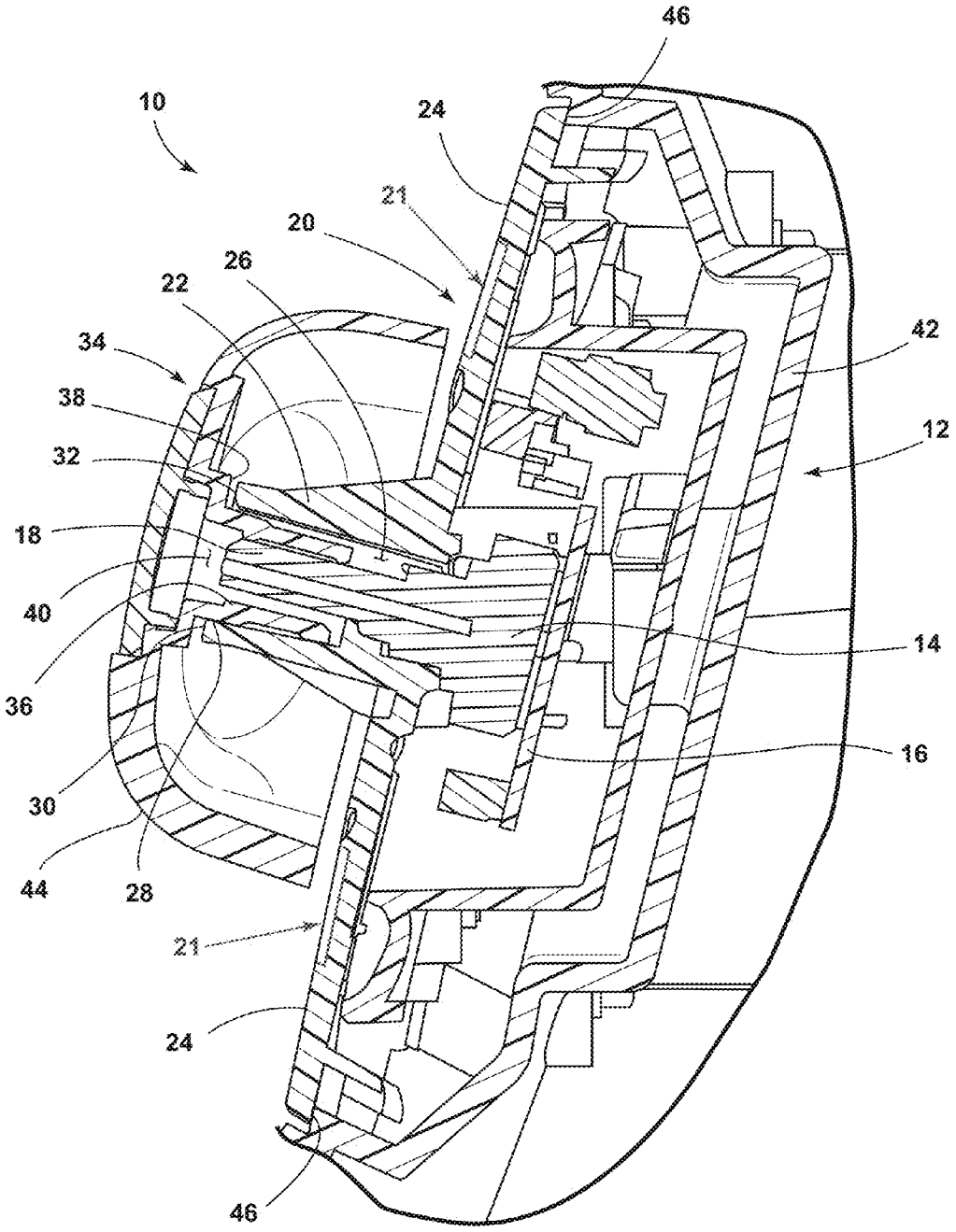
46
10
24
21
20
26
22
34
38
32
18
40
36
30
44
28
21
24
46
42
12
14
16

CYCLE SELECTOR KNOB TO ROTARY ENCODER USER INTERFACE

CROSS REFERENCE TO RELATED APPLICATIONS

This application claims the benefit of U.S. Application Ser. No. 61/791,440 filed Mar. 15, 2013, incorporated herein in its entirety.

FIELD OF THE INVENTION

The invention relates to a cycle selector knob to rotary encoder user interface for an appliance.

BACKGROUND OF THE INVENTION

In the past it has been difficult to design an inexpensive knob to rotary encoder structure for appliances without some compromise in either the robust feeling of the knob or the perceived quality of the detent function.

Typically, for a cycle selection using a knob to rotary encoder user interface, a plastic bearing supporting the knob around the rotary encoder is designed to a minimal gap relationship to provide robust function of the knob. However, this design approach is subject to part process noises that lead to part interactions that create issues such as drag, or friction between the knob and the support bearing that changes the perceived quality of the function. Another solution is designing the knob without bearing structure to achieve the perceived quality.

BRIEF DESCRIPTION OF THE INVENTION

In one aspect, the invention relates to a cycle selector knob to rotary encoder user interface for an appliance having a console and an electrical circuit inside the console to operate at least one function of the appliance. The user interface further comprises a rotary encoder assembly having a printed circuit board (PCB) connected to the electrical circuit and a rotating encoder shaft extending from the PCB. The rotating encoder shaft is received by a control panel barrel extending from a panel surface of the control panel to provide radial and thrust bearing surfaces. A knob for rotation of the rotating encoder shaft has a shoulder to bear against the thrust bearing surface of the barrel and an axial boss dimensioned to affix to the rotating encoder shaft and to bear against the radial bearing surface of the barrel. The control panel is secured to the console so that radial and thrust forces of the knob are directed via the radial and thrust bearing surfaces only to the console through the control panel.

BRIEF DESCRIPTION OF THE DRAWING

FIG. 1 is a cross-section view of a cycle selector knob-to-encoder interface for an appliance according to an embodiment of the invention.

DESCRIPTION OF EMBODIMENTS OF THE INVENTION

Referring now to the drawing, there is shown a cross-section view of a cycle selector knob to rotary encoder user interface 10 for an appliance according to an embodiment of the invention. The user interface 10 is mounted to a console 12 of an appliance that also has an electrical circuit (not shown) typically inside the console 12. The electrical circuit is electrically connected to the user interface 10 in any number of well-known ways. The console 12 comprises an outer console shell 42 and an inner structure for mounting various components of the user interface 10. A rotary encoder assembly 14 is disposed within the console shell 42. The rotary encoder assembly 14 comprises a printed circuit board (PCB) 16 and a rotating encoder shaft 18 extending from the PCB 16. A control panel 20 abutting the console 12 comprises a panel surface 24 and a barrel 22 extending from the panel surface 24. The barrel 22 has a central bore 26. A knob 34 is configured to communicate with both the barrel 22 and the rotating encoder shaft 18. The knob 34 comprises an outer shell 44, a shoulder 38 and an axial boss 36 having a recess 40.

It will be understood that the control panel 20, console 12, rotating encoder shaft 18 and knob 34 may be made from a variety of materials including but not limited to thermoset plastics or thermoplastics and may be manufactured in ways well known in the art, such as injection molding. The control panel 20, control panel surface 24 and barrel 22 may be integrally formed as one piece or separate pieces. Furthermore, the console 12 and control panel 24 may also be integrally formed as one piece or separate pieces.

The console 12 is configured to encompass various components of the user interface 10. The console shell 42 is disposed in a recess of the appliance, forming a void between the panel surface 24 of the control panel 20 and the console shell 42 so as to encompass the various component of the associated electric circuit (not shown) and parts of the rotary encoder assembly 14. The console shell 42 is rigidly mounted to the appliance.

The rotary encoder assembly 14 is configured to communicate with both the electrical circuit disposed within the console 12 and the knob 34. The PCB 16 is mounted within the console 12 and connected to the electrical circuit inside the console 12. The rotating encoder shaft 18 is rotatably connected to the PCB 16 and extends from the PCB 16 away from the console shell 42 such that the axis of rotation of the rotating encoder shaft 18 is generally normal to the panel surface 24.

The control panel 20 is secured to the console 12 such that contact is made between the console 12 and the control panel 20 at least at contacting locations 46. The control panel barrel 22 extends from the panel surface 24 away from the console 12 terminating at a terminal end 30 which forms a thrust bearing surface 32. The barrel 22 defines both a center bore 26 positioned to coaxially receive the rotating encoder shaft 18 as well as a radial bearing surface 28.

The control panel 20 may further comprise an in-mold-label (IML) 21 which is a label affixed to a molded part during the molding process. The IML 21 may be disposed on the panel surface 24 radially around the barrel 24 in a visible location and may comprise text, shapes and/or colors indicative of a cycle of operation or function of the appliance.

The barrel 22 may be integrally formed in the control panel 20. The barrel may be in the form of a hollow cylinder or in the form of a plurality of ribs radially positioned around the central bore 26 extending from the panel surface 24 away from the console 12.

The knob 34 is disposed over the side of the control panel 20 opposite the console 12 and configured to affix to the rotating encoder shaft 18 and bear against the inside of the barrel 22 when received by the center bore 26. The outer shell 44 of the knob 34 forms a substantially hemispherical shape wherein the outer shell 44 is facing away from the control panel 20 in a way to facilitate human interaction therewith. The knob 34 has an axial boss 36 extending from beneath the outer shell 44 of the knob 34 towards the control panel 24. The axial boss 36 forms a recess 40 for receiving the rotating encoder shaft 18. The knob 34 further comprises a shoulder 38 positioned to bear against the terminal end 30 of the barrel 22.

The rotary encoder assembly 14 mounts in the console 12 such that the rotating encoder shaft 18 extends into the central bore 26 of the control panel 20 that is mounted to the console 12. The axial boss 36 of the knob 34 is affixed to the rotating encoder shaft 22 in such a way that rotation of the knob 34 causes rotation of the rotating encoder shaft 18. The recess 40 is dimensioned so that at least a portion of the rotating encoder shaft 18 is received by the recess 40 and affixed to the axial boss 36 by means including but not limited to friction fit, a key, a detent, a set screw or any other way to affix a shaft to another object well known in the art.

The axial boss 36 is also dimensioned to be received by the barrel 22 in the center bore 26 such that the inside of the barrel 22 which defines the center bore 26 creates a radial bearing surface 28 between the axial boss 36 and the barrel 22. Furthermore, the axial boss 36 is dimensioned such the terminal end 30 of the barrel 22 creates a thrust bearing surface 32 between the shoulder 38 portion and the terminal end 30. The barrel 22 forming the radial bearing surface 28 and thrust bearing surface 32 may have a means to reduce friction with the axial boss 36. For example, the barrel 22 or axial boss 36 may be formed from a low friction plastic such as polytetrafluoroethylene, polyamide or polyethylene terephthalate or it may receive of coating of low friction lubricant prior to assembly.

During operation of the user interface 10, any radial and thrust forces imparted to the knob 34 are directed via the radial bearing surface 28 and thrust bearing surface 32, respectively, through the control panel 20, and into the console 12 of the appliance. A thrust force applied by a user to the knob 34 brings the shoulder 38 into contact with the terminal end 30 which provides the thrust bearing surface 32 and which directs the thrust force into the barrel 22. A radial force applied by a user on the knob 34 acting to rotate the rotating encoder shaft 18 is directed to the radial bearing surface 28 and into the barrel 22. Either or both of the forces are then directed to the control panel surface 24 through the barrel 22, through the control panel 20 at least at the connecting locations 46 and then to the console 12 of the appliance.

The embodiments described above provide for a variety of benefits including a high quality user experience and a robust user interface 10. This user interface 10 allows radial and thrust forces to be directly transferred to the console 12 and concurrently through the rest of the appliance. This helps to protect the knob 34 and rotary encoder 16 from rough handling and heavy customer use. The coaxial rotating encoder shaft 18, knob 34, axial boss 36 and 20 barrel 22 interface offers the most precise alignment of the user interface 10. This inherent design precision minimizes risk for the knob 34 rubbing the control panel surface 24 which would possible result in the degradation of perceived quality.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A user interface for an appliance having a console and an electrical circuit inside the console to operate at least one function of the appliance, the user interface comprising:

a rotary encoder assembly having a printed circuit board (PCB) connected to the electrical circuit and a rotating encoder shaft extending from the PCB;

a control panel, configured to be secured to the appliance console, and having a barrel extending from a panel surface, the panel surface having indicia related to the at least one function of the appliance wherein the barrel has a central bore that coaxially receives the rotating encoder shaft and the barrel provides a radial bearing surface and a terminal end that provides a thrust bearing surface; and a knob having an outer shell with a substantially hemispherical shape extending over and spaced from the panel surface, the rotation of which is related to the indicia on the panel surface, an axial boss extending from beneath the outer shell affixed to the rotating encoder shaft, and a shoulder positioned to bear against the thrust bearing surface of the barrel.

2. The user interface of claim 1 wherein the indicia are disposed radially around the barrel and outside the outer shell.

3. The user interface of claim 1 wherein the barrel and the control panel are a single piece.

4. The user interface of claim 1 wherein the control panel is plastic.

5. The user interface of claim 1 wherein the axial boss has a recess dimensioned to receive the rotating encoder shaft.

6. The user interface of claim 1 wherein the axial boss is affixed to the rotating encoder shaft by friction fit.

7. The user interface of claim 1 wherein at least one of the radial bearing surface or the thrust bearing surface has means to reduce friction.

8. The user interface of claim 7 wherein the means to reduce friction comprises at least one of a low friction plastic forming the barrel or axial boss or a low friction lubricant coating the barrel or axial boss.

9. The user interface of claim 8 wherein the means to reduce friction is a low friction plastic comprising at least one of polytetrafluoroethylene, polyamide or polyethylene terephthalate.

10. An appliance for treating a physical article comprising:

a console;

an electrical circuit inside the console to operate at least one function of the appliance; and a user interface;

wherein the user interface includes:

a rotary encoder assembly having a printed circuit board (PCB) connected to the electrical circuit and a rotating encoder shaft extending from the PCB;

a control panel, configured to be secured to the appliance console, and having a barrel extending from a panel surface, the panel surface having indicia related to the at least one function of the appliance wherein the barrel has a central bore that coaxially receives the rotating encoder shaft and the barrel provides a radial bearing surface and a terminal end that provides a thrust bearing surface; and a knob having an outer shell with a substantially hemispherical shape extending over and spaced from the panel surface, the rotation of which is related to the indicia on the panel surface, an axial boss extending from beneath the outer shell affixed to the rotating encoder shaft, and a shoulder positioned to bear against the thrust bearing surface of the barrel.

11. The appliance of claim 10 wherein the indicia are disposed radially around the barrel and outside the outer shell.

12. The appliance of claim 10 wherein the barrel and the control panel are a single piece.

13. The appliance of claim 10 wherein the control panel is plastic.

14. The appliance of claim 10 wherein the axial boss has a recess dimensioned to receive the rotating encoder shaft.

15. The appliance of claim 10 wherein the axial boss is affixed to the rotating encoder shaft by friction fit.

16. The appliance of claim 10 wherein at least one of the radial bearing surface or the thrust bearing surface has means to reduce friction.

17. The appliance of claim 16 wherein the means to reduce friction comprises at least one of a low friction plastic forming the barrel or axial boss or a low friction lubricant coating the barrel or axial boss.

18. The appliance of claim 17 wherein the means to reduce friction is a low friction plastic comprising at least one of polytetrafluoroethylene, polyamide or polyethylene terephthalate.

* * * * *